United States Patent [19]

Gustafson

[11] 4,020,339

[45] Apr. 26, 1977

[54] SYSTEM FOR DETERMINING THE DEVIATION OF AN OBJECT FROM A SIGHT LINE

[75] Inventor: Kjell Arne Håkan Gustafson, Karlskoga, Sweden

[73] Assignee: Aktiebolaget Bofars, Bofors, Sweden

[22] Filed: May 19, 1975

[21] Appl. No.: 578,977

[52] U.S. Cl. ..... 250/202; 244/3.13; 244/3.16; 356/152

[51] Int. Cl.[2] ..... G05B 1/00

[58] Field of Search .... 250/356, 202, 203, 203 CT; 356/1, 138, 141, 152; 244/3.13, 3.16, 3.14

[56] References Cited

UNITED STATES PATENTS

| | | | |
|---|---|---|---|
| 3,341,653 | 9/1967 | Kruse, Jr. | 250/203 CT |
| 3,796,396 | 3/1974 | Crovella | 244/3.13 |
| 3,864,043 | 2/1975 | Russell | 356/152 |

FOREIGN PATENTS OR APPLICATIONS

| | | | |
|---|---|---|---|
| 1,078,282 | 8/1967 | United Kingdom | 250/203 R |
| 756,176 | 8/1956 | United Kingdom | 244/3.13 |

*Primary Examiner*—David C. Nelms
*Attorney, Agent, or Firm*—Pollock, VandeSande and Priddy

[57] ABSTRACT

A system for determining the deviation of an object from a reference line, in particular for determining the deviation of a guided missile from a sight line extending from the missile launcher to a target, comprises a transmitter assembly at the origin of the reference line and a receiver assembly in the object. The transmitter assembly includes a radiation beam projecting device emitting a radiation beam in the direction of the reference line, this radiation beam being such that in planes perpendicular to the reference line it produces a radiation pattern composed of two elongated narrow radiation strips, which are mutually perpendicular and sweep alternatingly and periodically with a predetermined sweeping frequency over the reference line in directions at right angles to their respective longitudinal directions. The receiver assembly in the object includes a radiation detector mounted to be activated by the radiation beam so as to generate an electric output signal which is modulated in response to the movement of the radiation pattern of the radiation beam relative to the radiation detector, and signal processing circuits receiving the output signal from the radiation detector and including time measuring means for determining the time interval between each passage of a radiation strip over the radiation detector and a reference time corresponding to a predetermined position of the radiation strips relative to the reference line.

15 Claims, 12 Drawing Figures

SYSTEM FOR DETERMINING THE DEVIATION OF AN OBJECT FROM A SIGHT LINE

The present invention relates to a system for determining the deviation of an object, especially a moving object, from a reference line or a sight line originating and extending from a distant reference point relative to the object, by using a beam of optical radiation emitted from the reference point in the direction of the reference or sight line. The system is particularly intended for an optical beam riding guidance system for a missile fired from the reference point or its immediate vicinity.

For optical beam riding guidance of a missile to a moving target, e.g. an aeroplane, it has already been proposed to emit a radiation beam of visible or preferably infra-red light, by means of a beam projecting device set up at the missile launching site or its immediate vicinity, the central axis of the light beam being kept constantly directed towards the moving target by turning the beam projector, i.e. so that the central axis of the emitted light beam continuously coincides with the sight line to the target. The missile is provided with a radiation detector sensitive to the radiation from the radiation beam, and arranged to be activated by the radiation in the radiation beam to generate an electrical signal in response thereto. The radiation beam is so formed that in a plane at right angles to the sight line it forms a predetermined geometrical radiation pattern which also moves in a predetermined manner relative to the sight line. The output signal from the radiation detector in the missile will thereby be modulated in a way which is determined by the geometrical form and movement of the radiation pattern. The form and movement of the radiation pattern relative to the sight line are further so selected that the modulation of the radiation detector output signal is dependent on the position of the radiation detector relative to the sight line and thus to the position of the missile, whereby it is possible, by analyzing the output signal of the radiation detector, to determine the deviation of the missile from the sight line both in elevation and azimuth. On the basis of this information the steering means of the missile can be activated so that the missile is caused to travel along the sight line to the target.

The system according to the present invention, for determining the deviation of an object from a reference line by means of an optical radiation beam emitted along the reference line, is also of the above-mentioned, general kind, which has previously been proposed. The practical realization of a system of this kind is however beset with considerable difficulties, which have not been provided with any satisfactory solution in previously proposed systems.

High intensity of the emitted radiation is thus striven for in order to achieve the greatest possible range with a sufficiently large signal to noise ratio in the output signal from the radiation detector on the missile for a certain maximum output power of the radiation source in the beam projecting device. In turn, this means that the cross-section area of the radiation beam should be small. The total duration of the radiation emission should also be kept short so that energy consumption and development of heat in the beam projector will be low. Thereby it will also be more difficult for an enemy to discover the radiation emitter, but corresponding difficulties for the receiving unit in the missile naturally occur at the same time. The output signal from the radiation detector on the missile will also contain a considerable amount of disturbances, above all generated by the sunlight striking the radiation detector, this light varying considerably in strength depending on the movement of the missile in relation to the sun, and it can also be heavily modulated by the atmosphere and the exhaust gases being expelled from the propulsion means of the missile. Modulation of the sunlight can be of very high frequency, if the missile moves with high speed. In a corresponding manner, the emitted radiation beam is naturally affected by the air strata between the beam projector and the missile, as well as by the exhaust gases expelled from the propulsion means of the missile, whereby a large part of the information transmitted by the radiation beam can be lost or distorted. The object of the present invention is therefore to provide an improved system of the aforementioned type for determining the deviation of an object from a reference line originating from a reference point distant from the object, particularly for optical beam riding guidance of a missile, in which system the problems discussed above have been satisfactorily solved.

For this object the invention provides a system for determining the deviation of an object from a reference line originatng and extending from a reference point distant from said object, which system comprises a transmitter assembly at said reference point, including a radiation beam projecting device for emitting a radiation beam in the direction of the reference line, this radiation beam producing in a plane at right angles to the reference line a predetermined radiation pattern moving in a predetermined manner relative to the reference line; and a receiver assembly in said object, including a radiation detector activated by said radiation beam to generate an electric output signal modulated in response to the movement of said radiation pattern relative to the radiation detector, and signal processing circuits responsive to said output signal for evaluating the position of the object relative to the reference line; said radiation pattern being composed of two elongated narrow strips of radiation, which are mutually at right angles and sweep alternatingly and periodically with a predetermined sweeping frequency over the reference line in a direction at right angles to their respective longitudinal direction, and said signal processing circuits in said receiver assembly including time measuring means for determining the time interval between each passage of a radiation strip over said radiation detector and a reference time corresponding to a predetermined position of the radiation strips relative to the reference line.

The invention and the advantages obtained with it will be described more in detail in the following with reference to the accompanying drawings, which by way of example illustrate a preferred embodiment of the invention. In the drawings:

FIG. 1 schematically illustrates the basic arrangement of a system for optical beam riding guidance of a missile;

FIG. 2*a*–2*d* schematically illustrate the appearance of the radiation pattern produced by the radiation beam used in the illustrated embodiment of a system according to the invention, at four different times during a cycle for the periodical movement of the radiation pattern relative to the sight line;

Figure 1:
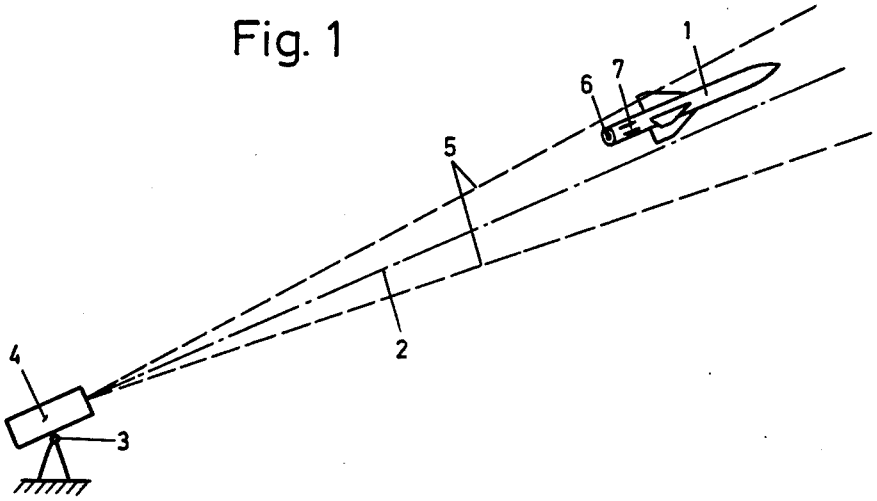

FIG. 1 shows schematically the general design of a system for optical beam riding guidance of a missile 1 to follow a reference or sight line 2, originating from a reference point 3 from which or in the vicinity of which the missile 1 has been fired. For determining the position of the missile 1 relative to the sight line 2 there is a radiation beam emitter or transmitter generally denoted by the numeral 4 at the reference point 3, for sending a radiation beam of a visible or infra-red light, schematically denoted by dotted lines 5, in the direction of the sight line 2. A radiation detector 6 is mounted facing backwards on the missile, the detector being for example a photodiode which is sensitive to the radiation from the emitted radiation beam 5 and generates an electric output signal responsive to illumination of the radiation detector 6 by the radiation beam. This signal is supplied to a receiver installed in the missile, and generally denoted by the numeral 7, said receiver being adapted to analyze the output signal from the radiation detector 6 to determine the position of the missile 1 in elevation and azimuth relative to the sight line 2. The steering means of the missile 1 are activated in response to this positional information so that the missile is caused to follow the sight line 2. If the missile 1 is intended to strike a moving target, the transmitter 4 is turned so that the sight line 2, and thereby the radiation beam, is continuously kept directed on the target.

In the embodiment of the invention shown as an example, the radiation beam 5 emitted by the transmitter 4 is so formed that in a plane at right angles to the sight line 2 it produces a radiation pattern composed of two elongated narrow rectangles of radiation, termed hereafter as "radiation strips," which are mutually at right angles and sweep alternatingly and periodically with a predetermined sweeping frequency backwards and forwards over the sight line 2 in a direction at right angles to their respective longitudinal directions.

Figure 2A:
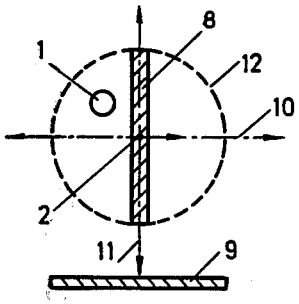
Figure 2B:
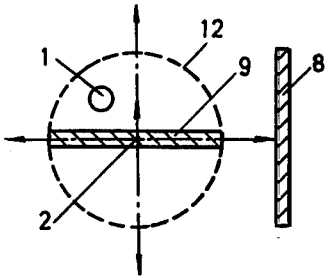
Figure 2C:
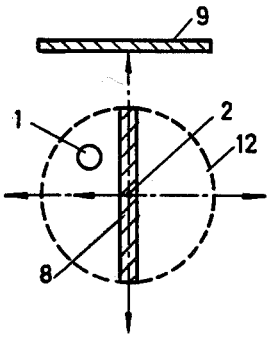
Figure 2D:
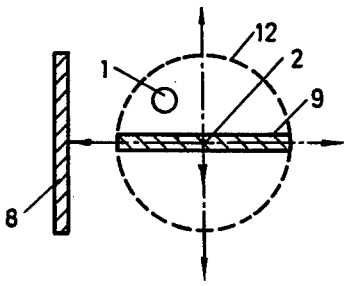

The appearance and movement of the radiation pattern relative to the sight line 2 is more easily seen from FIGS. 2*a*–2*d*, which illustrate the appearance of the radiation pattern at four different times during a complete sweeping cycle. As mentioned above, and as is shown in FIG. 2, the radiation pattern of the radiation beam consists of two straight narrow strips 8 and 9 which are mutually at right angles. Preferably the one radiation strip 8 is vertical, while the other radiation strip 9 is horizontal. The vertical radiation strip 8 sweeps periodically in a horizontal direction symmetrically backwards and forwards over the sight line 2 with a sweeping amplitude indicated by the chain dotted arrow 10. The horizontal radiation strip 9 sweeps periodically in a corresponding way in a vertical direction symmetrically backwards and forwards over the sight line 2 with a sweeping amplitude indicated by the chain dotted arrow 11. There is a phase lag of 90° between the sweeping movements of the radiation strips 8 and 9, and the length of the strips and the sweeping amplitude are preferably so adjusted that the radiation strips never cross each other during their sweeping movement. A guidance corridor is thus obtained for the missile 1, indicated by a dotted circle 12, within which only one radiation strip is to be found at any moment. Just as one radiation strip leaves this guidance corridor, the other radiation strip enters the guidance corridor. If it is assumed that the sweeping movement cycle for the radiation strips 8 and 9 begins with the radiation strips in the position shown in FIG. 2*a*, wherein the vertical radiation strip 8 is crossing the sight line 2 and is moving to the right in the guidance corridor, as is indicated by an arrow, while the horizontal radiation strip 9 is at its lower turning point, then 90° later on in the sweeping cycle there is obviously the situation as shown in FIG. 2*b*, in which the vertical radiation strip 8 is at its right-hand turning point, whereas the horizontal radiation strip 9 is crossing the sight line 2 while moving upward through the guidance corridor. 180° from the start of the sweeping cycle, there is the situation shown in FIG. 2*c*, in which the horizontal radiation strip 9 is at its upper turning point, while the vertical radiation strip 8 is cutting the sight line 2 while moving to the left through the guidance corridor. 270° after the sweeping cycle has started there is the situation as shown in FIG. 2*d*, wherein the vertical radiation strip 8 is at its left turning point, while the horizontal radiation strip 9 is cutting the sight line 2 while moving downward through the guidance corridor.

Since the emitted radiation pattern, the radiation beam, only consists of two narrow radiation strips 8, 9 with a small total area, the radiation intensity within the strips can be kept high, without the total emitted radiation power needing to be high.

Figure 3:
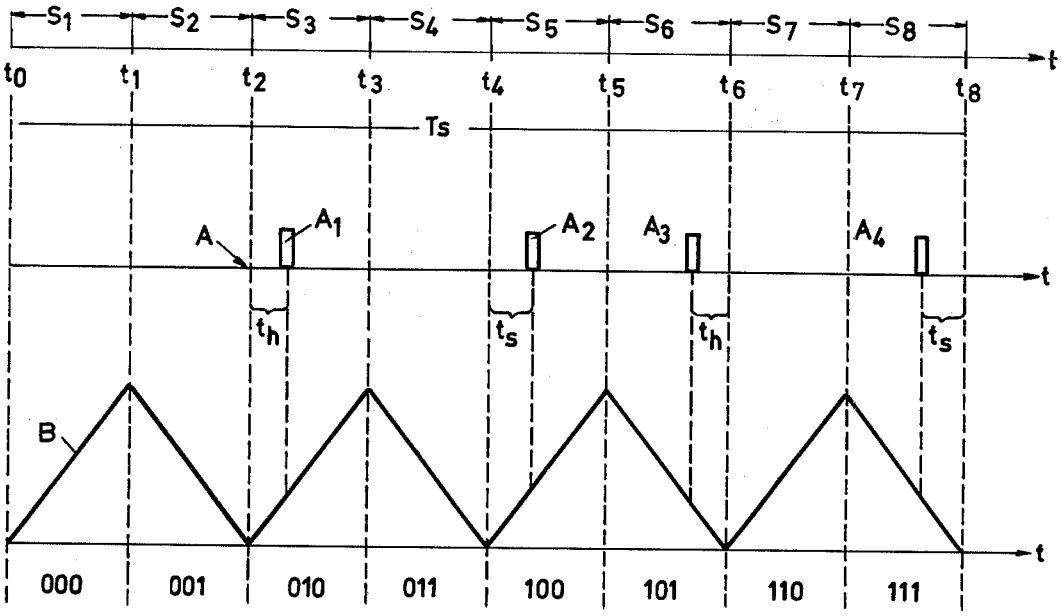
FIG. 3 is a diagram illustrating the principle mode of operation of the system according to the invention illustrated as an example.

From the preceding, it is understood that a sweeping cycle for the strips 8 and 9 having the length or period $T_s$ can be divided up, in the manner shown uppermost in FIG. 3, into eight equally long sections $S_1 - S_8$, each embracing 45° of the sweeping cycle. If the time $t_0$ at the beginning of the sweeping cycle is assumed to correspond to the position shown in FIG. 2*a* for the radiation strips, the vertical radiation strip 8 will cut the sight line 2 at times $t_0$, $t_4$ and $t_8$, while the horizontal radiation strip 9 will cut the sight line 2 at the times $t_2$ and $t_6$. There is thus the following relationship between the different sections $S_1 - S_8$ of the sweeping cycle and the movement of the radiation strips within the control corridor:

Section $S_1$ = radiation strip 8 moving to the right within the right-hand half of the guidance corridor.

Section $S_2$ = radiation strip 9 moving upwards within the lower half of the guidance corridor.

Section $S_3$ = radiation strip 9 moving upwards within the upper half of the guidance corridor.

Section $S_4$ = radiation strip 8 moving to the left within the right-hand half of the guidance corridor.

Section $S_5$ = radiation strip 8 moving to the left within the left-hand half of the guidance corridor.

Section $S_6$ = radiation strip 9 moving downwards within the upper half of the guidance corridor.

Section $S_7$ = radiation strip 9 moving downwards within the lower half of the guidance corridor.

Section $S_8$ = radiation strip 8 moving to the right within the left-hand half of the guidance corridor.

If the missile 1 is assumed to have the position within the guidance corridor as illustrated in FIGS. 2*a*–2*d*, an output signal will be obtained from the radiation detector 6 mounted on the missile 1, having the principle appearance illustrated by graph A in FIG. 3. The output signal thus consists of four short signals $A_1$, $A_2$, $A_3$ and $A_4$ for each sweeping cycle, the signals having a length determined by the width and sweeping speed of the radiation strips 8, 9. The signals $A_1$ and $A_3$ are derived from the horizontal radiation strip 9, while the signals $A_2$ and $A_4$ are derived from the vertical radiation strip 8. Further, it is appreciated that the time interval $t_h$ between the time $t_2$ and the center of signal $A_1$, and between the time $t_6$ and the center of signal $A_3$ respectively, will be equally long and represent the elevational deviation of the missile 1 from the sight line 2. In a corresponding manner the time interval $t_s$ between time $t_4$ and the center of the signal $A_2$, and between the time $t_8$ and the center of signal $A_4$ respectively, will be equally long and represent the deviation of the missile 1 from the sight line 2 in azimuth. By measuring the time intervals $t_h$ and $t_s$ in the receiver 7 of the missile 1, it is thus possible to determine the deviation of missile 1 from the sight line 2 both in elevation and azimuth; this information being obtained twice for both elevational deviation and deviation in azimuth during each sweeping cycle of the radiation strips 8 and 9.

To determine the time intervals $t_s$ and $t_h$ an automatically reversing pulse counter is preferably used in the invention. This counter is synchronized with the sweeping movement of the radiation strips 8, 9 so as to contain the count 0 at the time $t_0$, when the sweeping cycle starts, and is driven by a clock pulse series with the frequency $$f_k = 8N_1 f_s$$

where $f_k$ is the frequency of the clock pulse series, $N_1$ is the reversing counter counting capacity, and $f_s$ is the sweeping frequency of the radiation strips 8, 9, i.e. $f_s = 1/T_s$. The count in this reversing counter during one sweeping cycle will thus vary in the way illustrated by graph B in FIG. 3. It will be appreciated that the count in this counter at the time for the center of signal $A_1$ will constitute a measurement of the time interval $t_h$, and thereby a measure of the elevational deviation of the missile from the sight line 2, whereas the count in the counter at the time for the center of signal $A_2$ will constitute a measurement of the time interval $t_s$ and thereby a measure of the deviation in azimuth of the missile from the sight line 2. The same thing applies for the count in the counter at the times for the centers of the signals $A_3$ and $A_4$ respectively. According to the invention, the count in said reversing counter is therefore read out to a register and is converted to corresponding analogue signals at the time when the receiver 7, by detecting the signals $A_1$, $A_2$, $A_3$ and $A_4$ from the radiation detector 6, establishes that the radiation strips pass over the radiation detector.

For correct processing of the counts read out from said reversing counter, it is obviously necessary to know from which radiation strip a given signal $A_1$ to $A_4$ is derived, and within which part of the guidance corridor this radiation strip is to be found at that moment. In other words, it is necessary to know at every time within which section $S_1$ to $S_8$ of the current sweeping cycle the radiation strips 8, 9 are located, when a signal $A_1$ to $A_4$ occurs at the output of the radiation detector 6. According to the invention check is kept on the sections $S_1$ to $S_8$ of each sweeping cycle with the aid of a cyclic binary 3-bit counter, which is reset on 0 at the time $t_0$ simultaneously with the above-mentioned deviation counter, and which is driven by a pulse series with a frequency $8f_s$, so that it completes one counting cycle during each sweeping cycle of the radiation strips. The output signals from this binary 3-bit counter will thus, during the different sections $S_1$ to $S_8$ of each sweeping cycle, show the binary values set forth undermost in FIG. 3. Therefore, by scanning the output signals of the counter it is possible at any given moment to determine in which sections $S_1$ to $S_8$ of the current sweeping cycle the radiation strips are presently operating.

Further, in a system according to the invention, the emitted radiation beam, i.e. both the radiation strips 8 and 9, is preferably intensity modulated with a modulation frequency which is considerably higher than the sweeping frequency of the radiation strips. This intensity modulation is preferably a pulse modulation with a small pulse length ratio, so that the radiation pulses in the emitted beam have very short duration compared with the pauses between the radiation pulses. Hereby further considerable reduction of the total emitted radiation energy is obtained, and thus a corresponding reduction of the energy taken from the energy source of the beam transmitter, and of the heat losses in the radiation source, without any corresponding reduction of the intensity of the emitted radiation beam. In such a preferred embodiment of the invention, each of the signals $A_1$ to $A_4$ at the output of the radiation detector 6 will consist of a pulse train of short signal pulses, the length of the pulse train naturally being determined by the width and sweeping speed of the corresponding radiation strip. The radiation beam, i.e. the radiation strips 8 and 9, is preferably pulse modulated with a pulse repetition frequency $f_m$, which has a predetermined fixed relation to the sweeping frequency $f_s$ of the radiation strips. The pulse modulation of the radiation beam and thus of the output signal from the radiation detector in the missile can thereby be utilized in a very advantageous way for controlling the operation of the receiver, as will be more closely described later.

Figure 4:
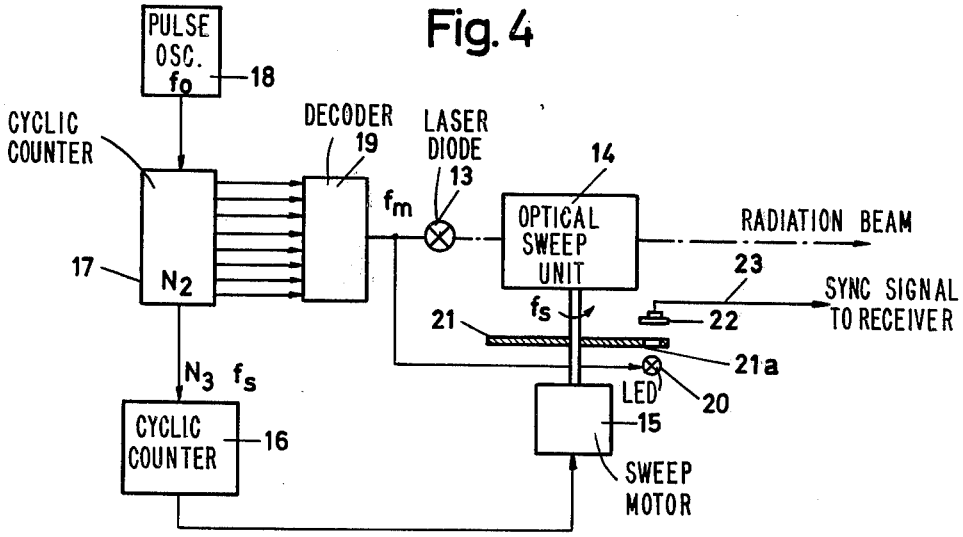
FIG. 4 is a block diagram of the transmitter unit in the embodiment of the invention shown as an example, only the portions of the transmitter unit which are of interest to the invention being shown.

FIG. 4 shows in the form of a block diagram the principle design of a beam transmitter in a preferred embodiment of the invention, only the portions of the transmitter which are of interest in connection with the invention being shown. The transmitter comprises a radiation source 13, e.g. a laser diode, for the radiation beam to be emitted, and an optical system 14 for producing the two radiation strips 8 and 9 in the beam and for periodical deflecting them so that the sweeping movement of the radiation strips is obtained as described in the foregoing. The sweeping movement is controlled by a sweep motor 15 which is mechanically coupled to the optical unit 14. The motor is assumed to rotate one revolution for each complete sweeping cycle of the radiation strips 8, 9 and has consequently the rotation frequency $f_s$. The optical unit 14 can in principle be of any suitable design. A suitable optical unit for the purpose is described in the copending U.S. application of Jan Lennart Borjeson, Ser. No. 578,965, for "Beam Projecting Device" filed on May 19, 1975, and assigned to the assignee of the present application. The sweep motor 15 is assumed to be a synchronous motor and is driven by a pulse series from a cyclic counter 16 operating as a frequency divider. The counter 16 is driven in turn by a pulse series from the last stage in a cyclic counter 17 which is in turn driven by a pulse series from an oscillator 18 generating a pulse series with the frequency $f_o$. The counter 17 is preferably a binary counter with the counting capacity $N_2$. The counter 16 is also preferably a binary counter and it is assumed that the counting capacity of the counter 16 and the number of poles in the sweep motor 15 are such that the ratio between the sweep motor 15 rotation frequency, i.e. the sweeping frequency $f_s$ of the radiation strips, and the frequency of the pulse series from the counter 17 driving the counter 16, is $N_3$. With these assumptions there is the following relationship:

$$f_o = N_2 N_3 f_s$$

A decoding circuit 19 is connected to all stages in the cyclic counter 17, and arranged to produce an output pulse at its output when the count in counter 17 reaches a certain predetermined value, for example the value $N_2$. Once during each counting cycle of the counter 17 a short pulse is produced at the output of the decoder 19, the length of this pulse being of the same order of magnitude as the period length in the pulse series from the oscillator 18. The output signal from the decoder 19 has consequently a small pulse length ratio and the pulse repetition frequency $f_o/N_2$. The pulse series from the decoder 19 excites the radiation source 13 through suitable power circuits, not shown in detail in the drawings, to emit a correspondingly pulse modulated radiation beam. The pulse modulation frequency $f_m$ of the emitted radiation beam is thus determined by the pulse repetition frequency of the pulse series from the decoder 19. The relationship is:

$$f_o = N_2 f_m$$

and also $$f_m = N_3 f_s$$

Thus, there is a fixed unalterable relationship between the sweeping frequency $f_s$ of the radiation strips and their pulse modulation frequency $f_m$, which relation is not altered by possible changes in the frequency $f_o$ of the pulse oscillator.

As an illustrative numerical example, it can be mentioned that in a system according to the invention for optical beam riding guidance of an antiaircraft missile, the sweeping frequency of the radiation strips may have a value within the range of 10–30 Hz, and the modulation frequency $f_m$ of the radiation beam may have a value within the range of 10–20 kHz with a pulse length within the range 100–300 ns and thus a pulse length ratio of the order of magnitude of 1/100 – 1/1000. The radiation strips may have, for example, such a width and such a sweeping speed that the radiation detector on the missile is activated by 5–10 radiation pulses during the passage of one radiation strip.

The pulse series from the decoder 19, with the pulse repetition frequency $f_m$ controls also a light source 20, e.g. in the form of a LED (light emitting diode), which is arranged on one side of a rotating disk 21 connected to the shaft of the sweep motor 15 and thus rotating with the sweeping frequency $f_s$. On the opposite side of the disk 21 there is a photo detector 22, e.g. a photo diode, arranged directly opposite the LED 20. The rotating disk 21 is provided with an opening 21a having such a position that it lets through light from the LED 20 to the photo diode 22 when the radiation strips 8,9 in the emitted radiation beam assume a certain definite position, e.g. that shown in FIG. 2*a*, which corresponds to the time $t_o$ in the diagram in FIG. 3. When the radiation strips in the generated beam assume this position, a short signal pulse is obtained on the conductor 23. This signal pulse also coincides in time with a signal pulse from the decoder 19 and thereby with an emitted radiation pulse in the beam. The signal pulse thus occurring on the conductor 23 is applied to the receiver in the missile before the launching of the missile and is utilized, as will be described more closely further on, in the receiving unit in the missile for initial synchronization of the receiver with the transmitter, inter alia by resetting the aforementioned counters.

Figure 5:
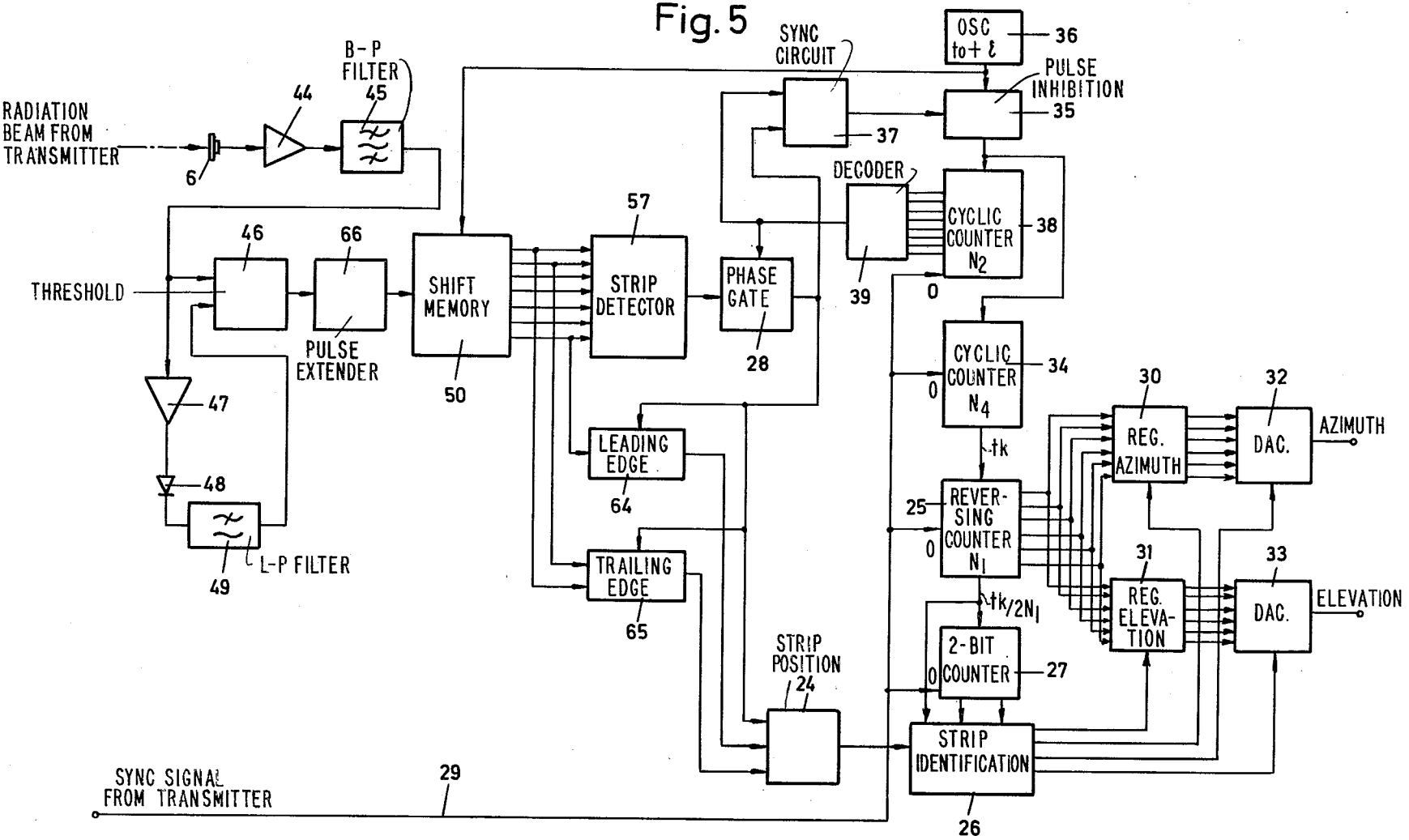
FIG. 5 is a block diagram of the receiver unit in the embodiment of the invention shown as an example.

FIG. 5 shows a block diagram for a preferred embodiment of the receiving unit in the missile, which is controlled by the output signal from the radiation detector 6. After signal processing in various circuits, which will be more closely described further on, the output signal from the photo detector 6 gives rise on the one hand to a short signal pulse on the output of a phase gating circuit 28, in principle for each transmitted radiation pulse in the beam which strikes the photo detector 6, and on the other hand a short signal pulse on the output from a radiation strip positioning circuit 24 at a time representing the time at which the center line of a radiation strip 8 or 9 respectively, passes over the radiation detector 6, i.e. in principle at the center points of the signals $A_1$, $A_2$, $A_3$ and $A_4$ in the diagram in FIG. 3.

The receiving unit includes the aforementioned reversing counter 25 which is driven by a clock pulse series with the frequency $$f_k = 8N_1 f_s$$

The counter 25 is a binary counter with a counting capacity of $N_1$ and since it is an automatically reversing up-down counter, a pulse series taken from the last stage of the counter has the frequency $f_k/2N_1$. This pulse series is applied to a logical circuit 26 and to a binary 2-bit counter 27, from both stages of which pulse series are also taken to the logical circuit 26. It will be appreciated that the last counting stage in the counter 25 together with the 2-bit counter 27 forms a 3-bit binary counter, driven with the pulse frequency $f_k/N_1$, i.e. the frequency $8f_s$ (see the relationship between $f_k$ and $f_s$ given above ), and therefore the digital signals on the three inputs to the logical circuit 26 will be changed during a sweeping cycle for the radiation strips in the manner previously described and shown undermost in FIG. 3. The logical circuit 26 is thus provided with continuous information on which section $S_1$ to $S_8$ the radiation strips are to be found at any given time in the current sweeping cycle. As described above, in connection with FIG. 3, a condition for this is that the counters 25 and 27 are synchronized with the sweeping movement of the radiation strips, by their being reset at the time $t_o$ in FIG. 3. This is achieved by the signal pulse on the line 23, described in connection with the transmitter in FIG. 4, being transferred via the line 29 in the receiver unit in FIG. 5 to the reset terminals of the counters 25 and 27 before the launching of the missile. When the missile is launched, the connection between the line 23 in the transmitter in FIG. 4 and the line 29 in the receiver in FIG. 5 is broken, after which the counters 25 and 27 are automatically kept synchronous with the sweeping movement for the radiation strips 8, 9 generated in the transmitter, providing that the relationship between the clock pulse frequency $f_k$ and the sweeping frequency $f_s$ $$f_k = 8N_1 f_s$$

is constantly maintained. How this takes place will be more closely described in the following.

There are two registers 30 and 31 connected to the counter 25, each being provided with a DAC (Digital-/Analogue Converter) 32 and 33 respectively, which convert the digital counts registered in respective register 30 and 31 to the corresponding analogue signals with optionally one or the other polarity. The register 30 is intended to register the count in the counter 25 when the vertical radiation strip 8 activates the radiation detector 6, i.e. on reception of signals $A_2$ and $A_4$ in FIG. 3, whereby the DAC 32 will give an analogue signal representing the azimuth deviation of the missile from the sight line 2. In a corresponding manner the register 31 is intended to register the count in the counter 25 when the horizontal radiation strip 9 activates the radiation detector 6, i.e. on reception of the signals $A_1$ and $A_3$ in FIG. 3, so that the DAC 33 gives an analogue signal on its output representing the deviation in elevation of the missile from the sight line 2. The reading-in of the count in the counter 25 into the register 30 or alternatively the register 31, and the sign choice in the DAC's 32 and 33 are controlled by the logical circuit 26, which, as mentioned above, keeps track of the different sections $S_1 - S_8$ of the current sweeping cycle, in compliance with the following program:

| Section of the Sweeping Cycle | Register Read-in | Sign in the corresponding DAC |
|---|---|---|
| $S_1$ | 30 azimuth | + in 32 |
| $S_2$ | 31 elevation | − in 33 |
| $S_3$ | 31 elevation | + in 33 |
| $S_4$ | 30 azimuth | + in 32 |
| $S_5$ | 30 azimuth | − in 32 |
| $S_6$ | 31 elevation | + in 33 |
| $S_7$ | 31 elevation | − in 33 |
| $S_8$ | 30 azimuth | − in 32 |

Reading-in to the appropriate register 30 or 31 takes place at the moment when the logical circuit 26 receives the aforementioned signal pulses from the radiation strip positioning circuit 24. In this way there is always an analogue signal in the output of the DAC 32, representing the azimuth deviation from the sight line 2 of the missile, a positive sign of the signal indicating that the missile is to the right of the sight line, while a negative sign of the signal indicates that the missile is to the left of the sight line. In a corresponding manner there is an analogue signal constantly on the output of the other DAC 33, representing the elevational deviation of the missile from the sight line 2, a positive sign of the signal indicating that the missile is lying above the sight line, while a negative sign of the signal indicates that the missile is below the sight line. The analogue signals on the outputs of the DAC's are obviously up-dated twice during each sweeping cycle of the radiation strips.

The logical circuit 26 is not shown in detail, as it can be designed in a manner conventional per se to operate according to the above-mentioned program.

The clock pulse series with the frequency $f_k$ controlling the counter 25 is obtained from a cyclic counter 34 working as a frequency divider, which is driven in turn by a pulse series obtained via a pulse inhibiting circuit 35 from an oscillator 36. The oscillator 36 has the frequency $f_o + \epsilon$, where $\epsilon$ is very small compared with $f_o$. The nominal frequency of the receiver oscillator 36 thus somewhat exceeds the nominal frequency $f_o$ of the transmitter oscillator 18 (FIG. 4). It will however be appreciated that both the transmitter oscillator 18 and the receiver oscillator 36 can alter their frequencies somewhat from their nominal values during their storage time and also during operation of the system. Ths purpose of the pulse inhibiting circuit 35 is to inhibit such a manner of the pulses in the pulse series from the oscillator 36, in response to inhibiting pulses from a synchronizing circuit 37, that the clock pulse series driving the counter 24 constantly has an average pulse frequency $f_k$, which meets the previously stated condition:

$$f_k = 8N_1 f_s$$

Since $$f_o = N_2 N_3 f_s \text{ (see FIG. 4)}$$

the following relationship clearly applies:

$$f_o = \frac{N_2 N_3 f_k}{8N_1}$$

The counting capacity $N_4$ of the frequency dividing counter 34 must thus meet the condition:

$$N_4 = \frac{N_2 N_3}{8N_1}$$

The necessary pulse inhibition in the inhibiting circuit 35 is determine in principle by comparing the frequency $f_m$ of the radiation beam pulses received by the radiation detector 6, which has the fixed relationship to the sweeping frequency $f_s$ (see FIG. 4) of $$f_m = N_3 f_s,$$

with a synchronizing pulse series in the receiver, which is derived from the pulse series of the receiver oscillator 36 via the inhibiting circuit 35 in such a manner that its frequency agrees with the beam modulation frequency $f_m$ when inhibition is correct. For this purpose the receiver comprises a cyclic counter 38 with the same counting capacity $N_2$ as the counter 17 in the transmitter (FIG. 4), to which a decoding circuit 39 is connected, which provides on its output a synchronizing pulse series with the frequency $f_{sync}$ and consisting of short pulses with a small pulse length ratio of the same order of magnitude as the pulse length ratio for the beam modulation pulses. If there is no pulse inhibition in the inhibiting circuit 35, the synchronizing pulse series pulse frequency $f_{sync}$ will obviously somewhat exceed the pulse modulation frequency $f_m$ of the beam. The counters 38 and 34 are reset simultaneously with the counters 25 and 27 before the launching of the missile, and therefore the pulses in the sync pulse series from the decoding circuit 39 will occur somewhat before the signal pulses on the output of the radiation detector 6, which are caused by the radiation pulses in the beam and which, as previously mentioned, give rise to corresponding signal pulses on the output of the phase gating circuit 28.

The signal pulses on the output of the phase gating circuit 28, which coincide in time with the radiation beam pulses received by the radiation detector 6, are supplied to the synchronizing circuit 37 to which the sync pulse series from the decoding circuit 39 is also supplied. The radiation beam pulses from the gating circuit 28 and the sync pulses from the decoder 39 thus arrive at the synchronizing circuit 37 with the mutual relationship illustrated in the diagram in FIG. 9, where the graph C shows the sync pulse series from the decoder 39 while the graph D shows the radiation beam pulses from the phase gating circuit 28.

Figure 8:
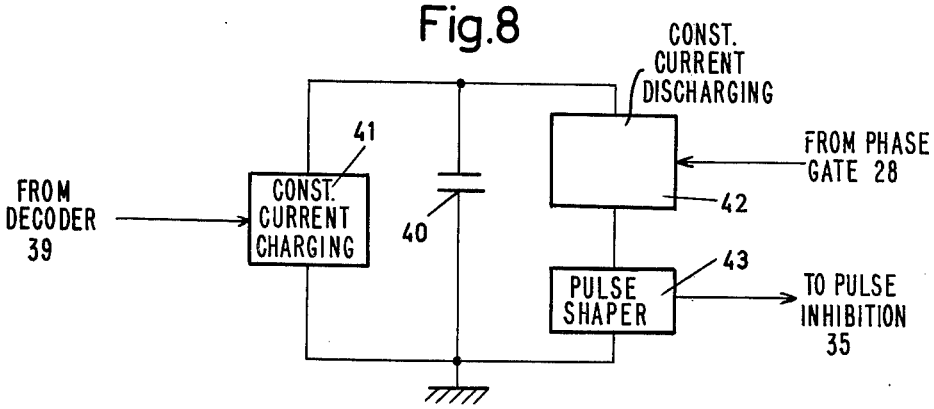
FIG. 8 is a more detailed block diagram of a possible embodiment of the synchronizing circuits for the receiver shown in FIG. 5.
Figure 9:
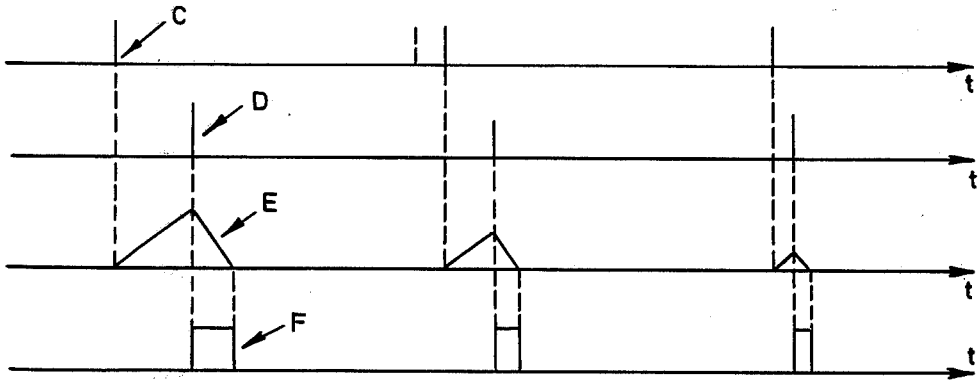
FIG. 9 is a diagram illustrating the mode of operation of the synchronizing circuits in FIG. 8.

The synchronizing circuit 37 can be designed in the manner shown schematically in FIG. 8, for example. The synchronizing circuit includes a capacitor 40 provided with a charging circuit 41 for constant charging current, and a discharging circuit 42 for discharging the capacitor 40 with constant discharge current. The charging circuit 41 is activated by the sync pulses from the decoder 39 so that a charging of the capacitor 40 with constant current is started for each sync pulse. The discharging circuit 42 is controlled by the radiation beam pulses from the phase gating circuit 28, so that charging the capacitor 40 is interrupted and its discharge with constant discharge current is initiated when a radiation beam pulse occurs on the output of the phase gating circuit 28. The voltage across the capacitor 40 thus varies in the manner illustrated by the graph E in FIG. 9. In series with the discharge circuit 42 there is a pulse shaping circuit 43, which on its output generates a signal as long as the discharge current flows through the discharge circuit. Signal pulses of the kind illustrated by the graph F in FIG. 9 are thus obtained from the pulse shaper 43. These pulses are utilized as inhibiting pulses and are applied to the pulse inhibiting circuit 35, which interrupts the pulse series from the oscillator 36 for the duration of each inhibiting pulse. It is appreciated that the sync pulse series (graph C in FIG. 9) is thereby delayed so that the sync pulses approach the radiation beam pulses closer and closer (graph D in FIG. 9), and that the clock pulse series is thereby provided with an average pulse frequency $f_k$, which meets the necessary condition $$f_k = 8N_1 f_s,$$

and at the same time is caused to retain the necessary synchronization with the sweeping movement of the radiation strips. It is appreciated that radiation beam pulses from the phase gating circuit 28 do not occur after every sync pulse from the decoder 39, since radiation beam pulses on the output of the phase gating circuit 28 only occur when the radiation detector 6 is activated by a radiation strip 8. 9. However, for each radiation strip, i.e. four times during each sweeping cycle, an adjustment and synchronization of the clock pulse series is obtained. The frequency difference $\epsilon$ between the transmitter oscillator 18 and the receiver oscillator 36 is so small that the radiation beam pulse series and the sync pulse series do not manage to drift from each other more than a fraction of a period during the time interval between the activations of the radiation detector 6 by two successive radiation strips. In the case when no radiation beam pulse has been received from the phase gating circuit 28 after a sync pulse from the decoder 39, a momentary discharge of the capacitor 40 takes place in the synchronizing circuit when the next sync pulse occurs.

As may be seen from the preceding, a short signal pulse train with the pulse repetition frequency $f_m$ is obtained from the radiation detector 6 for each radiation strip 8 and 9 respectively, which activates the radiation detector 6. If it is assumed that each radiation strip activates the radiation detector 6 with 5 – 10 radiation pulses, then 20 – 40 corresponding signal pulses are obtained from the radiation detector 6 during each sweeping cycle, i.e. 300 – 600 signal pulses per second, if the sweeping frequency $f_s$ of the radiation strips is assumed to be 15 Hz. The number of signal pulses obtained from the radiation detector 6 for each radiation strip can vary rather widely, inter alia because of the effect the atmosphere and the exhaust gases of the missile have on the radiation beam. Certain signal pulses can thereby disappear completely. There is furthermore a considerable number of disturbances on the output of the radiation detector 6, caused by sunlight illuminating the radiation detector. These disturbances occur continuously and not only when a radiation strip from the radiation beam activates the detector 6, and they can vary substantially in amplitude and frequency depending on the intensity of the sunlight and modulation from the atmosphere and the exhaust gases from the missile. It is therefore imperative to separate, in the total signal obtained from the radiation detector 6, the desired short signal pulses caused by the radiation strips 8, 9 in the emitted radiation beam from the disturbances in an as effective manner as possible.

For this purpose the total signal from the radiation detector 6 is transferred via an amplifier 44 to a bandpass filter 45, the bandpass of which is adapted to suit the pulse length of the useful signal pulses from the radiation detector 6, i.e. the length of the short radiation pulses in the emitted radiation beam. This means that the filter 45 only transfers the desired useful signal pulses and such noise pulses which have a pulse length of substantially the same order of magnitude as the useful signal pulses. Thus, for the separation of the useful signal pulses from the noise, knowledge of the pulse length of the useful signal pulses is utilized in the bandpass filter 45. Already in this way a large portion of the disturbances in the signal from the radiation detector 6 is eliminated.

The useful signal pulses and noise pulses of substantially the same length as the useful signal pulses contained in the output signal from the filter 45 are supplied to the input of a threshold amplifier 46, which has a variable controllable threshold level. The threshold level is controlled in that the output signal from the bandpass filter 45 is supplied also to the input level control terminal of the amplifier 46 via an amplifier 47, a rectifier 48 and a lowpass filter 49. The threshold level in the amplifier 46 is thus substantially determined by the amount of noise in the output signal from the bandpass filter 45, so that if there is much noise the threshold level is set high, while a low threshold level is set for little noise. For the signal noise separation is hereby utilized the condition that the radiation beam from the transmitter, which produces the desired useful signal pulses, and the sunlight, which causes the disturbance or noise signals, are in the main influenced in the same way by the atmosphere and the exhaust gases coming from the missile. By means of the threshold amplifier 46 a still further substantial portion of the disturbances in the output signal from the radiation detector 6 is eliminated, and from the threshold amplifier there is obtained an output signal consisting of useful signal pulses and noise pulses, both of them having the same amplitude and the same pulse length.

In this connection it should be noted that a portion of useful signal pulses could be eliminated in the threshold amplifier 46, since their amplitude falls below the threshold level prevailing at that moment.

On the output of the threshold amplifier 46, useful signal pulses and noise pulses can thus not be separated from each other except by utilizing the condition that the useful signal pulses occur with a pulse repetition frequency in agreement with the modulation frequency $f_m$ of the radiation beam. It should be noted here that the useful signal pulses only occur in the form of short pulse trains when the radiation strips 8,9 sweep over the radiation detector 6 and that certain of these useful pulse signals may furthermore have disappeared entirely. Knowledge of the pulse repetition frequency of the useful signal pulses is however utilized for separating the useful signal pulses from noise pulses with the help of a shift memory 50.

Figure 6:
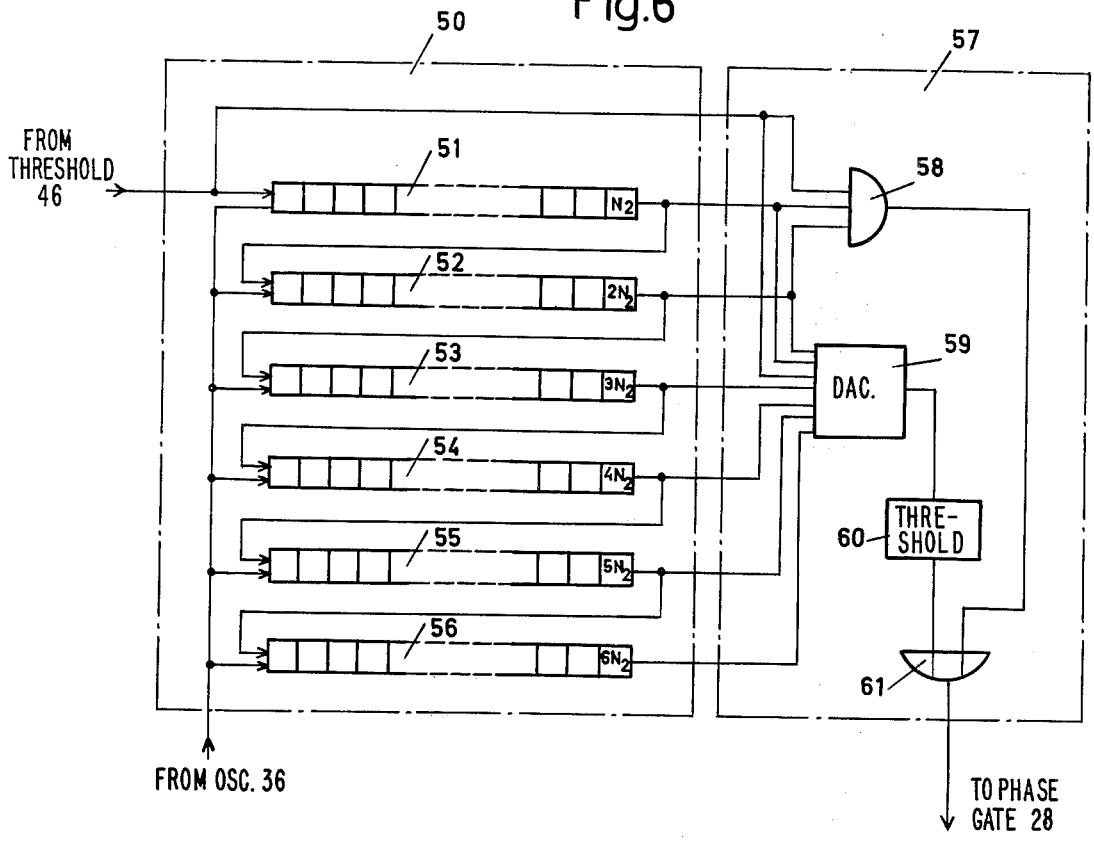
FIG. 6 is a more detailed block diagram of the shift register and the radiation strip detecting circuits in the receiver shown in FIG. 5.

The design principle of this shift memory 50 is apparent from FIG. 6. The shift memory consists of a number of exactly similar shift registers 51, 52, 53, 54, 55, 56, six in number in the illustrated embodiment, which each contain $N_2$ storage places and which are cascade connected in the manner shown on the drawing. The output signal from the threshold amplifier 46 is applied to the input of the first shift register 51 via a pulse extending circuit 66. The last storage place in the shift register 51 has thus the serial number $N_2$, while the last storage place in the shift register 52 has the serial number $2N_2$, the last storage place in the shift register 53 the serial number $3N_2$ and so on, reckoned from the signal input of the first shift register 51. The shift registers are driven by the pulse series from the oscillator 36, whereby the signal from the threshold amplifier 46 is sampled with the frequency $f_o + \epsilon$, and the sampled signal states are shifted through the cascade connected shift registers 51–56 with the same frequency. The useful signal pulses in the output signal from the threshold amplifier 46 have, when the radiation detector 6 is activated by a radiation strip, the frequency $f_m = f_o/N_2$ (see FIG. 4). The time between two consecutive useful signal pulses is always $T_m = N_2/f_o$. This time obviously deviates somewhat from the time $T_t$, which it takes for a useful signal pulse to be shifted through an entire shift register to its last storage place, since this time $T_t = N_2/(f_o + \epsilon)$, i.e. it is somewhat shorter than $T_m$. In this connection it should be noted that the output signal from the threshold amplifier 46 consists of short pulses (useful signal pulses and noise pulses) with the same amplitude and substantially the same length, the signal therefore being of a binary nature. It will be appreciated that if useful signal pulses were to occur on the input of the shaft register 51 with a mutual time interval $T_m = T_t$, i.e. $\epsilon = 0$, then they would also be present simultaneously in the last storage places of the shift registers 51 – 56. Since now $T_t < T_m$, it may happen that a useful signal pulse, entered into the shift memory 50, has arrived at the last storage place in a shift register before the subsequent useful signal pulse has reached the last storage place of the preceding shift register. Such a pulse position lag can, occur regardless of how small the frequency difference $\epsilon$ is, as long as $\epsilon > 0$. In the embodiment shown, this difficulty is avoided by the pulse extender 66, which prolongs each useful signal pulse to such an extent that it is with certainty entered into two sequential storage places in the shift register. Even if a pulse position lag of the kind described above should occur between the outputs of the different registers, there will even so at a certain moment be useful signal pulses present simultaneously in all the last storage places of the shift registers 51 – 56, if a sufficiently long train of useful signal pulses has been applied to the input of the shift register 51 and the pulse position lag is only one shift step. If there are pulses stored simultaneously in the last storage places of all shift registers 51 – 56 and furthermore if there is a pulse present on the input of shift register 51, it can with very great probability be assumed that these pulses constitute useful signal pulses derived from radiation pulses in a radiation strip 8, 9 activating the radiation detector 6, since there is very little probability that seven noise pulses will occur with exactly the pulse repetition frequency of $f_m$. As has been previously mentioned, it can however happen that one or more useful signal pulses fall out and do not arrive at the output of threshold amplifier 46. It is therefore a too strict requirement that pulses shall be present simultaneously in the last storage places of all the shift registers 51 – 56 and also on the input of shift register 51, in order that a radiation strip shall be regarded as having activated the radiation detector 6. A logical circuit 57 is therefore used for detecting the radiation strips. This logical circuit 57 senses the signal states in the last storage places of the shift registers 51 – 56 as well as on the input of shift register 51, i.e. a total of seven signal states, and operates on the basis of a less severe condition for radiation strip detection than the one mentioned above.

In the logical circuit 57 for radiation strip detection, shown as an example in FIG. 6, the detecting conditions used are either that at least three pulses occur sequentially, with the pulse repetition frequency $f_m$ or that at least four pulses are present at the same time in the last storage places of the shift registers 51 – 56, and on the input of the shift register 51. Whether the first condition is fulfilled, is determined in the circuit 57 by means of an AND gate 58, the inputs of which are connected to the input of the shift register 51 and to the last storage places in the shift registers 51 and 52. If three pulses occur in sequence on the output of the threshold amplifier 46 with the pulse repetition frequency of $f_m$, these three pulses will occur simultaneously on the input of the shift register 51 and in the last storage places of the shift registers 51 and 52, whereby the AND circuit 58 provides a corresponding signal pulse on its output. The second of the above-mentioned conditions is determined by means of a DAC 59, the inputs of which are connected to the outputs of all the shift registers 51 – 56 and to the input of the shift register 51. This DAC is of the kind providing an analogue signal on its output, the value of which is proportional to the number of binary 1's on its inputs. The analogue output signal from the DAC 59 is connected to a threshold amplifier 60 having such a threshold level that it provides a signal on its output if the input signal level at least corresponds to four 1's on the inputs of the DAC 59. The output signal from the threshold amplifier 60 and the output signal from the AND circuit 58 are connected to an OR circuit 61, on the output of which is thus obtained a short signal pulse as soon as either of the abovementioned conditions is met in the shift memory 50. It is appreciated that every pulse on the output of the OR circuit 61 has a pulse length of substantially the same order of magnitude as the pulse length of the pulses on the output of pulse extender 66 and generally speaking coincides with such a pulse in time. It is further understood that every radiation strip 8, 9 which activates the radiation detector 6 and which gives rise to a useful signal pulse train with the pulse repetition frequency $f_m$ on the output of the radiation detector 6 and which contains a sufficient number of useful signal pulses to meet either of the aforementioned conditions, also gives rise to one or more signal pulses on the output of the radiation strip detecting circuit 57. The number of signal pulses obtained from the radiation strip detecting circuit 57 for one and the same radiation strip is determined by the number of useful signal pulses which the radiation strip gives rise to on the output of the threshold amplifier 46 and the time-space pattern which these useful signal pulses form, i.e. whether one or any useful pulse signal within the pulse train has been lost, and also by the number of registers in the shift memory 50 and the conditions to which the radiation strip detecting circuit 57 responds.

It will be understood that the shift memory 50 and the radiation strip detecting circuit 57 cause a further heavy reduction of the number of noise pulses in the signal, wherefore the signal on the output of the radiation strip detecting circuit 57 to all intents will consist of only true useful signal pulses. However, it cannot be completely ruled out that noise pulses in the signal on the output of the threshold amplifier 46 can in isolated cases occur in such a number and with such sequence that they meet the aforementioned conditions for the radiation strip detecting circuit 57 and thereby give rise to corresponding noise pulses on the output of the radiation strip detecting circuit 57. Such noise pulses can naturally occur with arbitrary phase position relative to the radiation pulses in the emitted radiation beam, while on the other hand, the true useful signal pulses on the output of the radiation strip detecting circuit 57 always occur synchronously with the radiation pulses in the emitted radiation beam. This condition is utilized for further elimination of noise pulses in the phase gating circuit 28, which is supplied with the output signal from the radiation strip detecting circuit 57.

Figure 7:
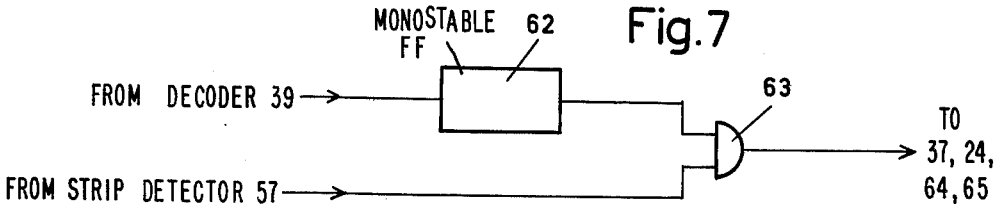
FIG. 7 is a more detailed block diagram of a possible embodiment of the phase gating circuits in the receiver shown in FIG. 5.

A simple construction of the phase gating circuit 28 is shown in FIG. 7. This phase gating circuit includes a monostable flip-flop 62, which is triggered by the sync pulses in the sync pulse series from the decoder 39, and which generates a pulse of predetermined length on its output for each sync pulse. This pulse is applied as an opening pulse to the one input on an AND gate 63, to the other input of which is applied the output signal from the radiation strip detecting circuit 57. On the output of the AND gate 63, and thereby that of the phase gating circuit 28 also, are obtained only such phases which occur within a certain time interval after the sync pulses as determined by the time constant of the flip-flop 62, i.e. practically entirely only useful signal pulses, since these always occur relatively soon after the sync pulses, as is evident from the preceding. Possible noise pulses, which can occur in any phase position relative to the sync pulses, are on the other hand not put through by the phase gating circuit 28. There is thus a very great probability of only true useful signal pulses, which derive from radiation pulses activating the radiation detector 6, occurring on the output of the phase gating circuit 28.

Through the signal processing described above of the output signal from the radiation detector 6 a very effective separation of the desired useful signal from all disturbances which can occur has been obtained.

As previously mentioned, each radiation strip 8, 9 activating the radiation detector 6 usually gives rise to a plurality of useful signal pulses on the output of the phase gating circuit 28. To activate the logical circuit 26 to enter the count in the counter 25 into either of the registers 30 or 31, only one signal pulse is required, since only one read-in is to take place for each radiation strip. It is further understood that the receiver cannot determine the time when the center line of a radiation strip passes over the radiation detector 6, which is the time when read-out of the count in the counter 25 really ought to take place, until the complete signal pulse train caused by the radiation strip has been received and processed in the receiver, since the length of such a signal pulse train can vary from case to case, depending inter alia on the effect from the atmosphere and the missile exhaust gases. To determine the center line of the radiation strip activating the radiation detector 6, there is therefore a first logical circuit 64 for determining the leading edge of the radiation strip, and a second logical circuit 65 for determining the trailing edge of the radiation strip. Both of these logical circuits 64, 65 are put into operation by the first signal pulse which a radiation strip gives rise to on the output of the phase gating circuit 28, i.e. when it has been verified that a radiation strip actually has affected the radiation detector 6. The leading edge detecting circuit 64, in the embodiment shown, samples the signal state in the last storage place in the last shift register 56 in the shift memory 50 and provides a short signal pulse on its output, when a signal pulse arises in said storage place after a signal pulse having occurred on the output of phase gating circuit 28. The trailing edge detecting circuit 65, in the embodiment shown, samples the signal state on the input and in the last storage place of the shift register 51 in the shift memory 50, and provides a short signal pulse on its own output, when signal pulses are absent simultaneously for the first time on the input of the shift register 51 and in its last storage place at the same time as signal pulses are found on a number of the remaining outputs of the registers, and after a signal pulse having occurred on the output of the phase gating circuit 28. These signal pulses from the leading edge detecting circuit 64 and the trailing edge detecting circuit 65 are applied, together with the signal pulses from the phase gating circuit 28, to the strip position determining circuit 24, which consists of a calculating circuit put into function by the first signal pulse from the phase gating circuit 28 caused by a radiation strip, but blocks possible sequential signal pulses from the phase gating circuit 28 caused by the same radiation strip, so that these do not have any effect. The calculating circuit 24 calculates, on the basis of the times at which the signal pulses from the leading edge detecting circuit 64 and the trailing edge detecting circuit 65 occur, the time at which the center line of the radiation strip causing the pulses in question has passed over the radiation detector 6 and generates on its output a short signal pulse occurring with a predetermined constant time lag after said calculated time. This output pulse from the circuit 24 activates the radiation strip identifying circuit 26 to carry out the transfer of the count in the counter 25 to either of the registers 30 or 31. The output pulses from the radiation strip position determining circuit 24 thus always occur with the same constant time lag after the times at which the center lines of the different radiation strips pass over the radiation detector 6. From what has now been described, it is apparent however, that for a correct determination of the position of the missile relative to the sight line 2 it is required, in principle, that the transfer of the count in the counter 25 to the registers 30 and 31 respectively, takes place at exactly the times when the center lines of the radiation strips in question pass over the radiation detector 6. The delay in the transfer of the count in the counter 25 caused by the radiation strip position determining circuit 24 can however be compensated for in that the counter 25 as well as the other counters 27, 34 and 38 are reset before the launching of the missile with an exactly corresponding time lag relative to the sweeping movement of the radiation strips with the aid of the synchronizing signal obtained from the transmitter on the conductor 29. In the transmitter, the required delay of the synchronizing signal on the conductor 23 can be accomplished by a corresponding displacement of the position of aperture 21*a* in the rotating disk 21.

It is appreciated that a plurality of modifications to the preferred embodiment of the invention described above are possible within the scope of the invention. For instance, the number of shift registers in the shift memory 50 can be different depending on the number of expected signal pulses in the pulse train which a radiation strip initiates. Furthermore, the functional conditions for the radiation strip detecting circuit 57, the leading edge detecting circuit 64 and the trailing edge detecting circuit 65 can naturally be chosen differently.

The sync circuit 37 and the phase gating circuit 28 can of course also be designed in other ways. For example, the phase gating circuit 28 can be designed more sophisticatedly so that the duration of the opening pulses is automatically made longer the greater the phase difference between the sync pulse series from the decoder 39 and the pulse modulation of the radiation beam can be expected to be. It is also understood that the phase gating circuit 28 can possibly be excluded, without this causing any serious deterioration of the separation between useful signals and disturbances.

In the embodiment shown, the necessary sync signal is transferred from the transmitter to the receiver by a galvanic connection (the conductors 23, 29) and only before the launching of the missile, i.e. before the system begins to work to determine the missile deviation from the sight line. In other applications of the invention there is of course nothing which prevents a corresponding sync signal being transmitted by a radio connection between the transmitter and the receiver, whereat in certain cases it may be suitable to carry out such synchronization several times during the operational time of the system. This can be especially the case in applications where the operational time of the system has a considerable length, and the signal disturbance separation is less effective, so that the continuous synchronization of the receiver with the help of the synchronizing circuit 37 may be affected by noise signals.

It is further appreciated that the problems caused in the shift memory 50 due to the difference between the transmitter oscillator frequency $f_o$ and the receiver oscillator frequency $f_o + \epsilon$, which have been solved with the help of the pulse extending circuit 66 in the described embodiment, can be solved instead by the radiation strip detecting circuit 57 being adapted to sample the signal state not only in the last storage place in each register 51 – 56, but also in the penultimate storage place in each register.

In the described embodiment of the invention, the radiation strips 8 and 9 sweep periodically backwards and forwards over the sight line. It is however understood that there is nothing preventing the radiation strip being deflected to sweep periodically over the sight line in only one direction, e.g. always from left to right for the vertical radiation strip 8, and always from the bottom up for the horizontal radiation strip 9. Such a sweeping movement for the radiation strips can be more advantageous from certain points of view, and does not require any substantial alterations to the receiver. What is required, in principle, is only that the radiation strip identifying circuit 26 and the counter 27 controlling it, are modified so that the radiation strip identifying circuit 26 can keep track of the different sections of the new sweeping cycle for the radiation strips and control the registers 30, 31 and the DAC's 32, 33 in agreement therewith.

What is claimed is:

1. A system for determining the deviation of an object from a reference line originating and extending from a reference point distant from the object, comprising a transmitter assembly located at said reference point and including a radiation beam projecting device for emitting a radiation beam in the direction of the reference line, said radiation beam projecting device being operative to produce in a plane at right angles to the reference line a radiation pattern composed of two elongated narrow strips of radiation which are mutually at right angles and which sweep alternatingly and periodically with a predetermined sweeping frequency $f_s$ over said reference line in a direction at right angles to their respective longitudinal directions; and a receiver assembly located in said object and including a radiation detector activated by said radiation beam to generate an electric output signal modulated in response to the movement of said strips relative to the radiation detector, and signal processing circuits responsive to said output signal for evaluating the position of the object relative to the reference line, said signal processing circuits including an automatically reversing first pulse counter driven by a clock pulse series and having a counting capacity of $N_1$ and adapted to be reset on the starting of the operation of the system in response to a signal from the transmitter assembly when a predetermined radiation strip is in a predetermined position relative to the reference line, said clock pulse series having a frequency $f_k$ complying with the condition $$f_k = 2KN_1 f_s$$

where K is an integer corresponding to the number of times, during a complete sweeping cycle for the radiation strips, that the reference line is passed over by a radiation strip, and registering means for registering, in response to the output signal from the radiation detector, the count in said first counter each time a radiation strip passes over the radiation detector.

2. A system as claimed in claim 1 wherein said predetermined position is the passage of said predetermined radiation strip over the reference line.

3. A system as claimed in claim 1, wherein said radiation beam projecting device is operative to cause said radiation strips to sweep backwards and forwards over the reference line.

4. A system as claimed in claim 1, wherein said register means include first and second registers connected to said first counter, first and second digital-analogue converters being connected to said first and second registers, respectively, for converting the digital count in said first and second registers into corresponding analogue signals having alternatively the one or the opposite polarity, and a first logical circuit for controlling the transfer of the count in said first counter into said first and second registers and determining the polarity of said analogue signals in response to the operation of a cyclic second counter, which has a counting capacity of 2K and is counting with a frequency of $2Kf_s$ and is reset simultaneously with said first counter, the operation logic of said first logical circuit being such that the count in said first counter is transferred into said first register when the one radiation strip passes over the radiation detector and into said second register when the second radiation strip passes over the radiation detector and that the analogue signal from said first converter has the one polarity when the count is transferred into the said first register while the said one radiation strip is on one side of the reference line and the opposite polarity when the count is transferred into said first register while the said one radiation strip is on the other side of the reference line, and that, in a corresponding manner, the analogue signal from said second converter has the one polarity when the count is transferred into said second register while said second radiation strip is on one side of the reference line and the opposite polarity when the count is transferred into said second register while said second radiation strip is on the other side of the reference line.

5. A system as claimed in claim 4, wherein said second counter is driven by a pulse series derived from said clock pulse series.

6. A system as claimed in claim 1, wherein said transmitter assembly includes means for intensity modulation of the radiation beam with a frequency $f_m$, which is a predetermined fixed multiple of the sweeping frequency $f_s$ of the radiation strips according to the relationship $$f_m = N_3 f_s$$

7. A system as claimed in claim 6, wherein said transmitter assembly includes an oscillator for controlling, via frequency dividing circuits, the said beam intensity modulating means as well as means creating said periodical sweeping movement of the radiation strips.

8. A system as claimed in claim 6, wherein said intensity modulation of the radiation beam is a pulse modulation with a small pulse width ratio of the order of magnitude 1/500.

9. A system as claimed in claim 6, wherein said receiver assembly includes a pulse oscillator and frequency dividing circuits for deriving from the output pulse series of said oscillator a synchronizing pulse series and said clock pulse series, means for comparing said synchronizing pulse series with the amplitude modulation of the output signal of said radiation detector caused by said intensity modulation of the radiation beam, and means responsive to said comparison means for adjusting the output pulse series of said oscillator in such a way that the frequency $f_{sync}$ of said synchronizing pulse series is caused to be equal to the modulation frequency $f_m$ of the radiation beam.

10. A system as claimed in claim 9, wherein said oscillator in the receiver assembly has a frequency such that the frequency $f_{sync}$ of said synchronizing pulse series, in the absence of said adjustment of the output pulse series of the oscillator, somewhat exceeds the pulse modulation frequency $f_m$ of the radiation beam; the pulses of the synchronizing pulse series and the modulation pulses of the radiation beam have a short relative pulse width of substantially the same order of magnitude; said comparison means include means for generating an inhibiting pulse with a duration dependent on the time interval between a synchronizing pulse and a subsequent modulation pulse in the output signal of the radiation detector, and said means for adjusting the output pulse series of the oscillator is an inhibiting circuit responsive to said inhibiting pulse for inhibiting the output pulse series of the oscillator for the duration of said inhibiting pulse.

11. A system as claimed in claim 8, wherein said receiver assembly includes a bandpass filter connected to the output of the radiation detector and having a bandpass matched to the pulse width of the modulation pulses of the radiation beam.

12. A system as claimed in claim 11, wherein a threshold circuit is connected to the output of said bandpass filter, said threshold circuit having a threshold level varying in response to the noise level in the signal applied to the threshold circuit so as to increase with an increasing noise level.

13. A system as claimed in claim 9, wherein said receiver assembly includes a shift memory with $n \times N$ storage places, receiving on its input the output signal of said radiation detector and being controlled by a shift pulse series with a frequency of approximately the value $Nf_m$, so that the output signal of the radiation detector is sampled with this frequency and the sampling results are entered into and successively shifted through the shift memory with this frequency; and a second logical circuit sampling simultaneously the signal states on the input of the shift memory and in the storage places with the serial numbers N, 2N, 3N . . . $n$N and generating an output signal pulse when the configuration of said sampled signal states meets a predetermined condition, the occurrence of said output signal pulse being utilized as a criterion that a radiation strip is passing over the radiation detector.

14. A system as claimed in claim 13, wherein said receiver assembly includes a gating circuit for the output signal pulses from said second logical circuit and a pulse generating circuit controlled by the synchronizing pulses so as to generate an opening pulse for said gating circuit in response to each synchronizing pulse, said opening pulse having a duration which constitutes only a small portion of the time interval between two consecutive synchronizing pulses.

15. A system as claimed in claim 13, wherein said receiver assembly includes: a third logical circuit responsive to the signal states in predetermined storage places in said shift memory and generating an output signal pulse indicating the leading edge of a radiation strip when said signal states meet a first predetermined condition after the occurrence of an output signal pulse from said second logical circuit; a fourth logical circuit responsive to the logical states in predetermined storage places in said shift memory and generating an output signal pulse indicating the trailing edge of a radiation strip when said signal states meet a second predetermined condition after the occurrence of an output signal pulse from said second logical circuit; and a calculating circuit responsive to said output signal pulses from said third and fourth logical circuit for calculating the time when the center of the radiation strip giving rise to said output signal pulses has passed over the radiation detector and generating an output signal pulse with a predetermined constant time lag after said calculated time, the output signal pulse from said calculating circuit being arranged to initiate the transfer of the count in said first counter into said register means; said first counter being reset from the transmitter assembly at a time having said time lag relative to the time when the center of a radiation strip passes over the reference line.

* * * * *